US007096915B2

(12) United States Patent
Yu Chen

(10) Patent No.: US 7,096,915 B2
(45) Date of Patent: Aug. 29, 2006

(54) TAPE-ROLL SUPPORTING DEVICE

(76) Inventor: Hsiu-Man Yu Chen, No. 27, Sec. 1, Ta Fu Road, Tan Tzu Hsiang, Taichung, 427 (TW)

( * ) Notice: Subject to any disclaimer, the term of this patent is extended or adjusted under 35 U.S.C. 154(b) by 0 days.

(21) Appl. No.: 10/981,517

(22) Filed: Nov. 5, 2004

(65) Prior Publication Data

US 2006/0096714 A1 May 11, 2006

(51) Int. Cl.
*B44C 7/02* (2006.01)

(52) U.S. Cl. ..... 156/577; 156/579; 225/47; 225/65

(58) Field of Classification Search ..... 156/574, 156/577, 579; 225/46, 47, 56, 65; 206/411; D19/67, 68, 69
See application file for complete search history.

(56) References Cited

U.S. PATENT DOCUMENTS 878,184 A * 2/1908 Braunlein ..... 156/577
3,529,504 A * 9/1970 Hagerty et al. ..... 83/464
4,316,564 A * 2/1982 Felicetti ..... 225/77
4,451,010 A * 5/1984 Meyer ..... 242/599.2
5,403,430 A * 4/1995 Araujo et al. ..... 156/523
5,445,703 A * 8/1995 Steeves et al. ..... 156/544
5,587,044 A * 12/1996 Goto ..... 156/577
2003/0102347 A1* 6/2003 Caviness ..... 225/43

* cited by examiner

*Primary Examiner*—Mark A. Osele
(74) *Attorney, Agent, or Firm*—Troxell Law Office PLLC

(57) ABSTRACT

A tape-roll supporting device consists of a shaft, a threaded tube and two side covers. The shaft is to be assembled on a machine body and the threaded tube is rotatably fitted around the outer side of the shaft for fitting and positioning thereon a tape roll of different widths. The two side covers are respectively bored with a threaded hole in the center to be threadably combined with the opposite ends of the threaded tube. The two side covers can be rotatably adjusted in position to closely clamp the tape roll fitted on the threaded tube between them, enabling a tape roll of different widths to be steadily fitted and positioned thereon.

1 Claim, 6 Drawing Sheets

TAPE-ROLL SUPPORTING DEVICE

BACKGROUND OF THE INVENTION

1. Field of the Invention

This invention relates to a tape-roll supporting device, particularly to one able to steadily receive thereon a tape roll of different widths.

2. Field of the Invention

A conventional tape-roll supporting device for receiving a tape roll, such as a label-tape roll, a packaging-strap roll or an adhesive-tape roll, includes a shaft and two side covers. The two side covers are respectively fixed with the opposite ends of the shaft and form an interval of a fixed width between them. Thus, a tape roll fitted around the shaft can be restricted in position by the two side covers.

However, the distance between the two side covers of the conventional tape-roll supporting device is fixed and impossible to be adjusted so only a specific-sized tape roll can be fitted therebetween.

SUMMARY OF THE INVENTION

The objective of the invention is to offer a tape-roll supporting device consisting of a shaft, a threaded tube and two side covers. The shaft is to be assembled on a machine body, and the threaded tube is rotatably fitted around the outer side of the shaft for fitting thereon a tape roll of different widths.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
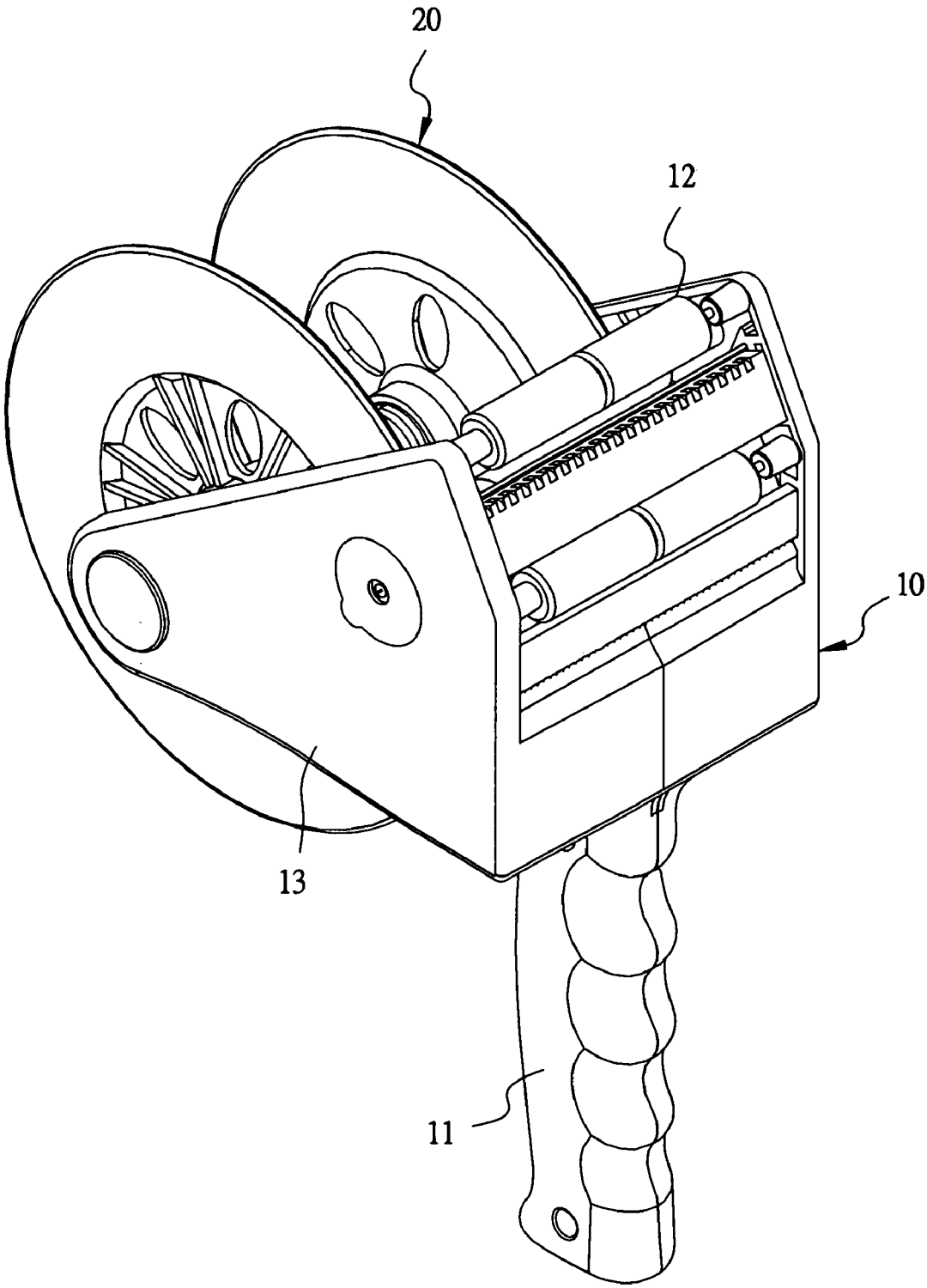
FIG. 1 a perspective view of a tape-roll supporting device assembled with a label-pasting apparatus in the present invention.
Figure 2:
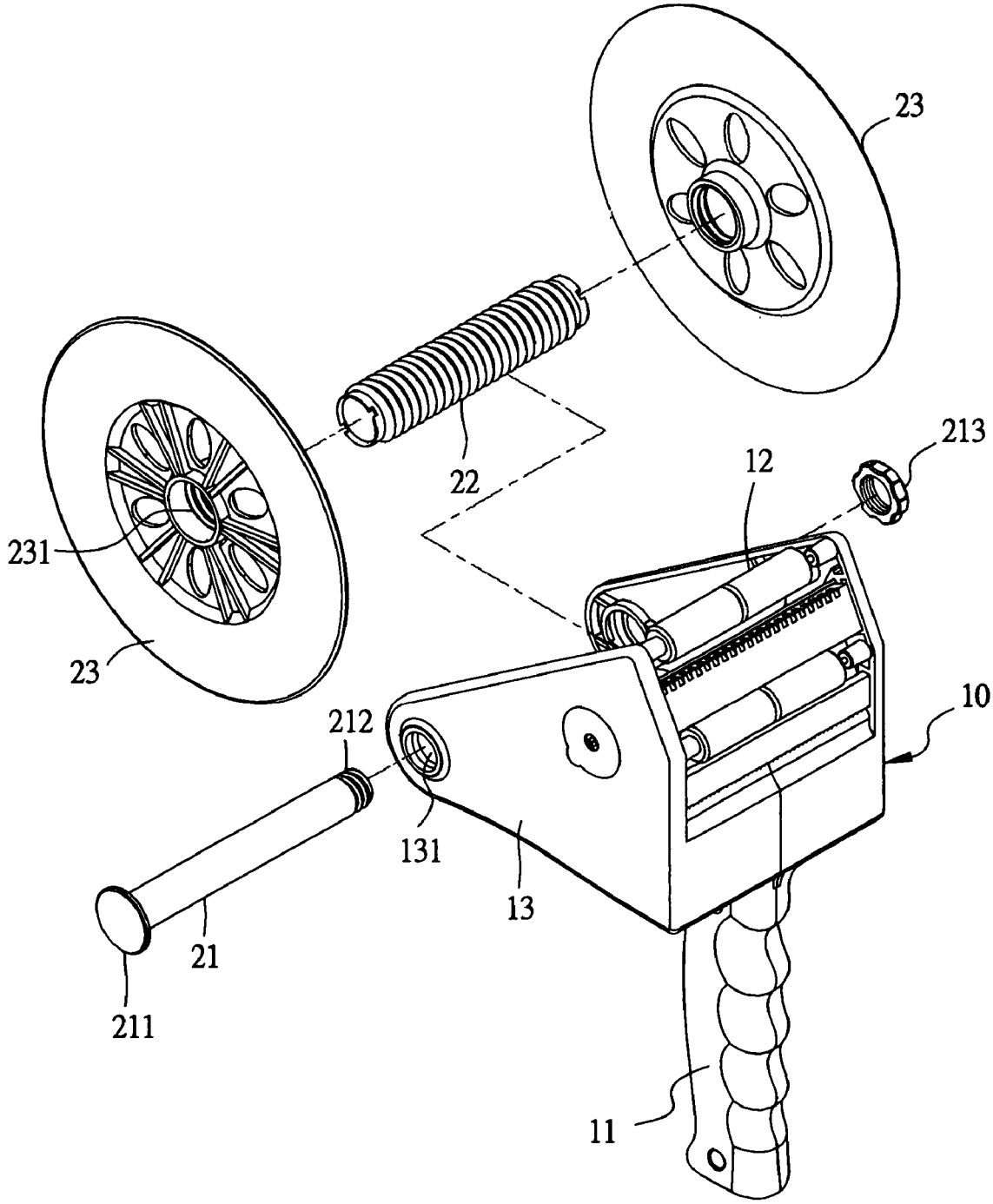
FIG. 2 is a partial exploded perspective view of the tape-roll supporting device to be assembled with a label-pasting apparatus in the present invention.
Figure 3:
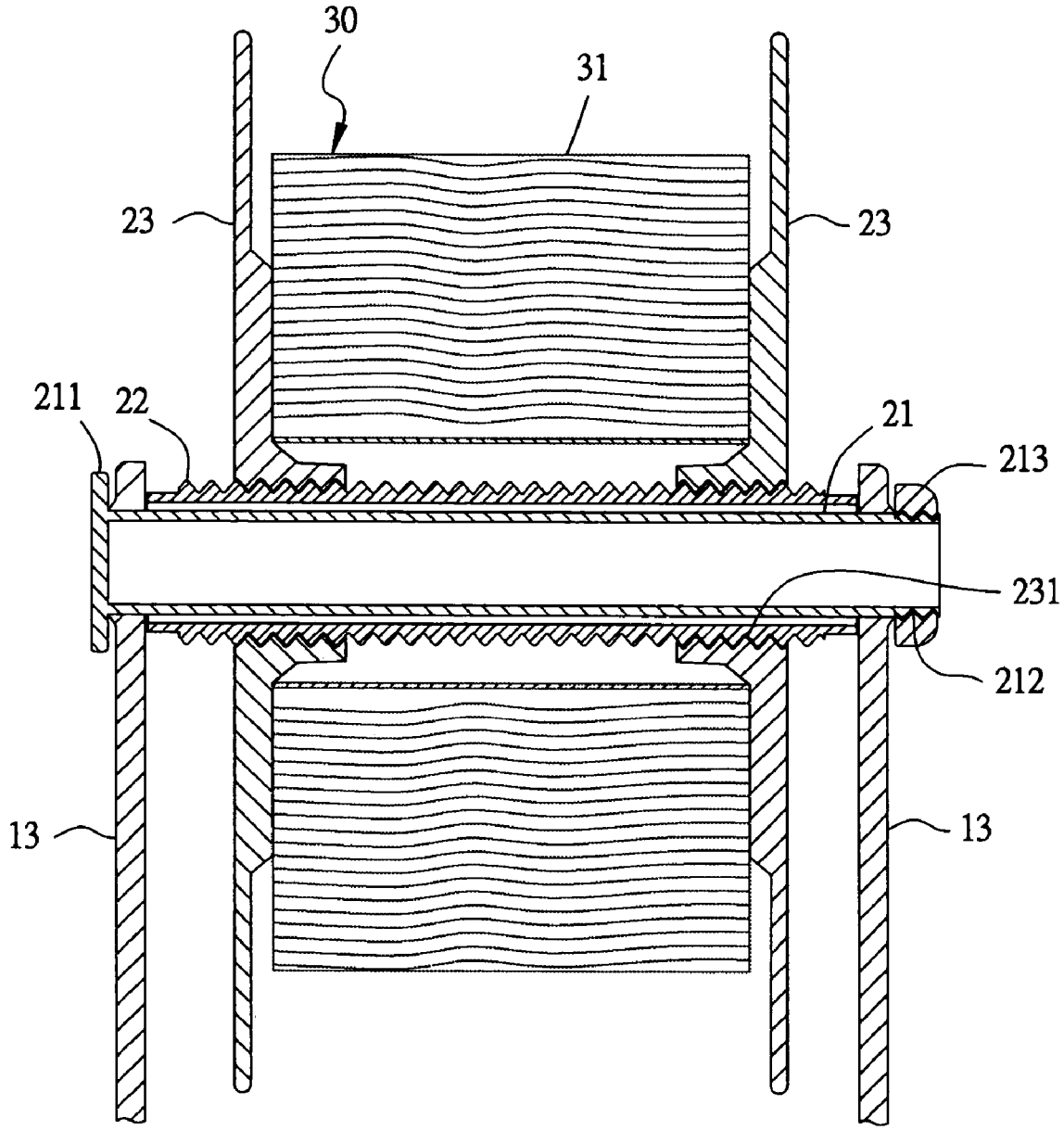
FIG. 3 a rear view of the tape-roll supporting device in the present invention.

A preferred embodiment of a tape-roll supporting device assembled with a label-pasting machine in the present invention, as shown in FIGS. 1, 2 and 3, includes a machine body 10 and a tape-roll wheel holder 20.

The machine body 10 is provided with a grip 11 extending downward from the bottom and a label guiding roller unit 12 on the upper side and also has its opposite sides respectively provided with a vertical combining plate 13 space apart at a preset distance. The two combining plates 13 are respectively bored with an insert hole 131 aligned to each other.

The tape-roll wheel holder 20 for supporting a tape roll 30 is fitted between the two insert holes 131 of the two combining plates 13. The tape-roll wheel holder 20 consists of a shaft 21, a threaded tube 22 and two side covers 23.

The shaft 21 has an outer end formed with a rim 211 with a comparatively large diameter and an inner end formed with male threads 212. The inner end with the male threads 212 of the shaft 21 can be inserted through the two insert holes 131 of the two combining plates 13, letting the male threads 212 extending out of the combining plate 13.

The threaded tube 22 is rotatably fitted around the shaft 21 for fitting and positioning thereon a tape roll 30 of different widths.

The two side covers 23 are respectively bored with a threaded hole 231 in the center to be threadably combined with the opposite ends of the threaded tube 22. The two side covers 23 can be rotatably adjusted in position so as to clamp the tape roll 30 fitted on the threaded tube 22. The inner end with the male threads 212 of the shaft 21 is screwed with a locking nut 213, letting the rim 211 and the locking nut 213 respectively and firmly secured on the opposite outer surfaces of the two combining plate 13.

Figure 4:
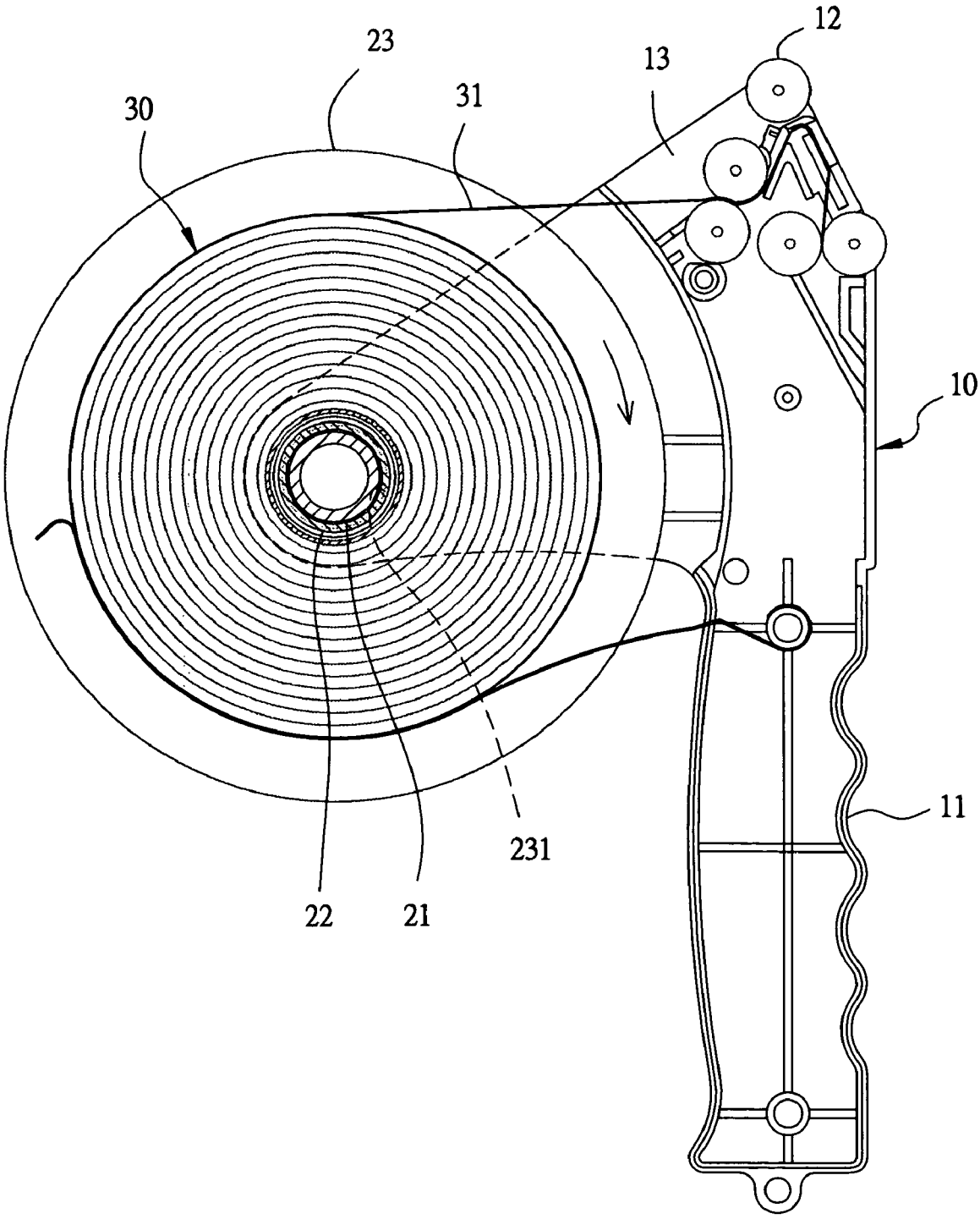
FIG. 4 is a side cross-sectional view of the tape-roll supporting device in the present invention, showing the tape of the tape roll is drawn and released.

In assembling, as shown in FIGS. 2 and 4, firstly, a label tape roll 30 is fitted around the threaded tube 22 and then the two side covers 23 are respectively and threadably combined with the opposite ends of the threaded tube 22 and rotatably adjusted in position to closely push against the opposite sides of the label tape roll 30. Next, the threaded tube 22 together with the two side covers 23 and the label tape roll 30 is positioned between the two insert holes 131 of the two combining plates 13 of the machine body 10. Lastly, the shaft 21 has the inner end with the male threads 212 inserted through both the two insert holes of the two combining plates 13 and the interior of the threaded tube 22, and then the locking nut 213 is screwed with the male threads 212 of the shaft 21 to finish assembly of the tape-roll wheel holder 20.

In using, when the label tape 31 on the label tape roll 30 is pulled outward, the label tape roll 30 clamped by the two side covers 23 will be actuated to turn together with the threaded tube 22, letting the threaded tube 22 rotate around the shaft 21. Thus, the label tape 31 can be released smoothly and steadily for carrying out pasting work.

Figure 5:
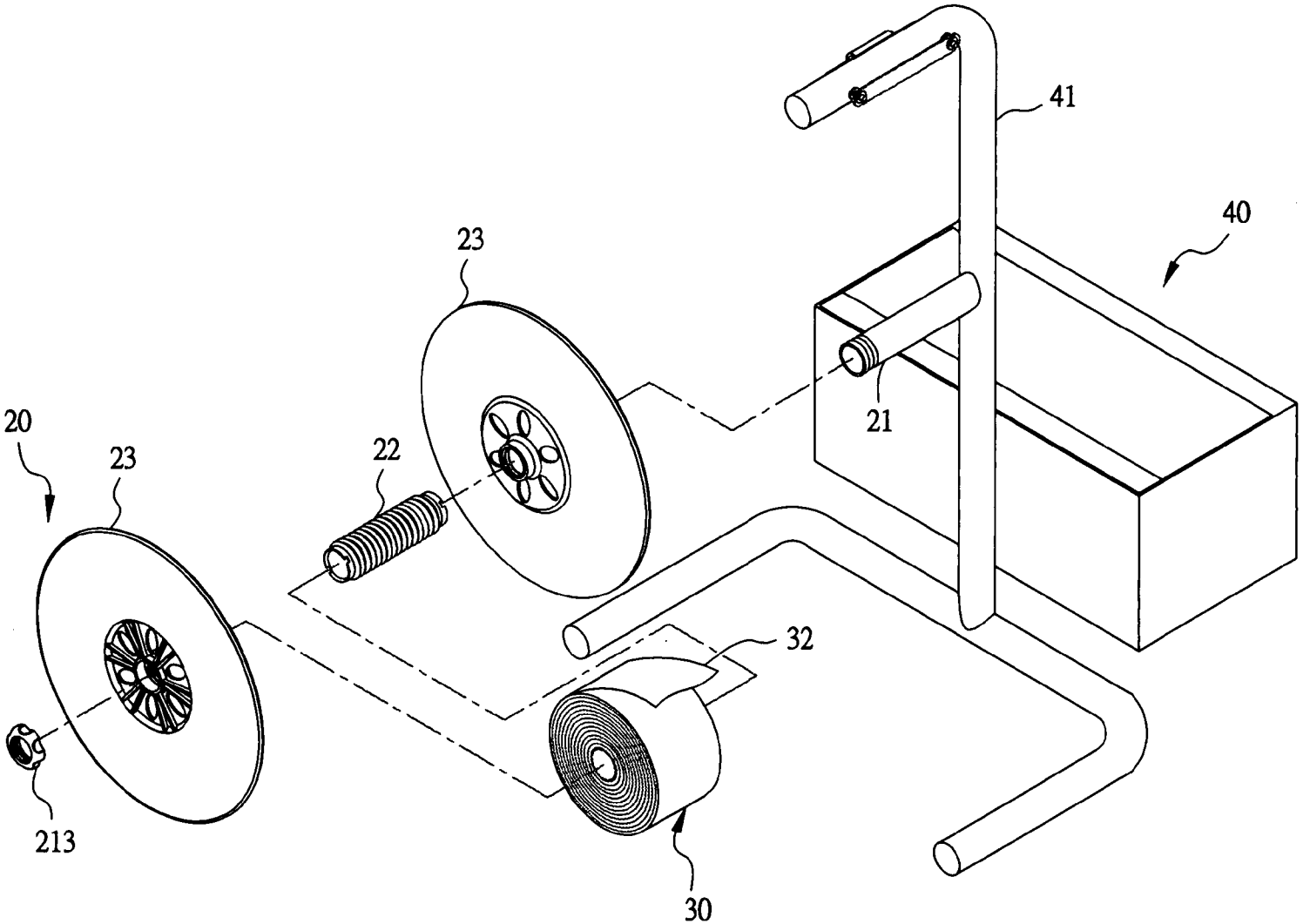
FIG. 5 is an exploded perspective view of the tape-roll supporting device to be assembled on a packaging-strap wheel frame in the present invention.

The tape-roll supporting device in the present invention can also be employed for fitting a packaging strap roll 30 or an adhesive-tape roll 30. If it is employed for fitting a packaging strap roll 30, as shown in FIG. 5, the shaft 21 of the tape-roll wheel holder 20 has one end assembled or made integral with the frame 41 of a packaging-strap wheel holder 40. Then, the threaded tube 22 threadably assembled with the two side covers 23 is fitted around the shaft 21 and the locking nut 213 is secured with the outer end of the shaft 21 to restrict the side covers 23 in position. Thus, when a packaging-strap roll 30 of different widths is fitted around the threaded tube 22 between the two side covers 23, it can be closely clamped by the two side covers 23 after the two side covers 23 are rotatably adjusted in position and it can also be rotated together with the threaded tube 22 to release packaging strap 32 for carrying out packaging.

Figure 6:
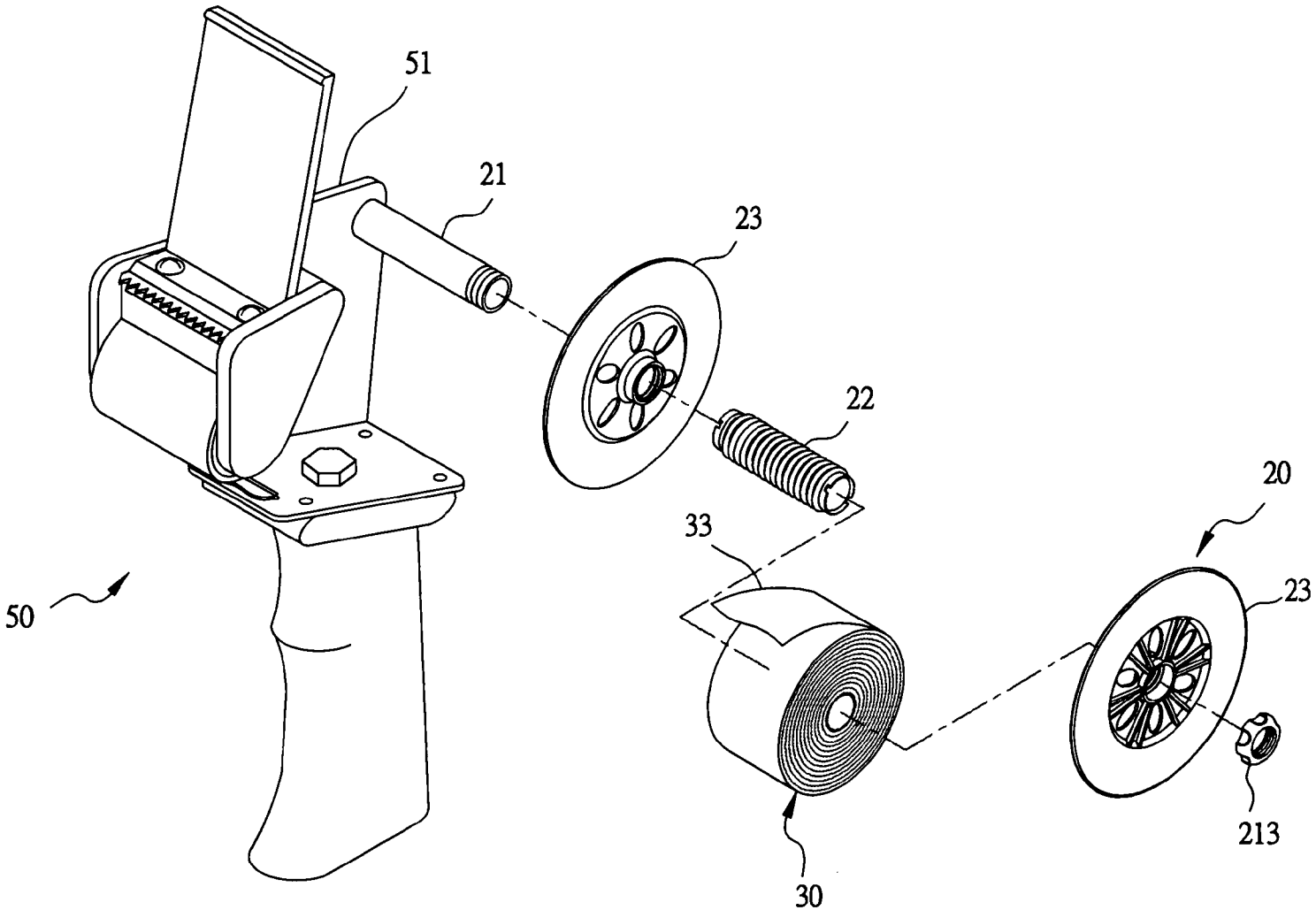
FIG. 6 an exploded perspective view of the tape-roll supporting device to be assembled with an adhesive-tape cutter in the present invention.

If the tape-roll supporting device of this invention is employed for fitting an adhesive-tape roll 30, as shown in FIG. 6, the shaft 21 of the tape-roll wheel holder 20 has one end assembled or made integral with the side plate 51 of an adhesive tape holder 50. Then, the threaded tube 22 threadably assembled with the two side covers 23 is fitted around the shaft 21 and the locking nut 213 is screwed with the outer end of the shaft 21 to restrict the side covers 23 in position.

Thus, when an adhesive-tape roll 30 of different widths is fitted around the threaded tube 22 between the two side covers 23, it can be closely clamped by the two side covers 23 after the two side covers 23 are rotatably adjusted in position and it can also be rotated together with the threaded tube 22 to release adhesive tape for carrying out pasting work.

To sum up, the tape-roll supporting device of this invention is able to closely clamp a tape roll 30 in position to prevent the tape roll 30 from sliding sideward and swaying to enable the tape roll 30 to release tape smoothly and steadily, elevating efficiency and quality in tape pasting or strap packaging and having extensive applicability.

While the preferred embodiment of the invention has been described above, it will be recognized and understood that various modifications may be made therein and the appended claims are intended to cover all such modifications that may fall within the spirit and scope of the invention.

I claim:

1. A tape-roll supporting device comprising:

a tape-roll wheel holder to be assembled with a machine body, said tape-roll wheel holder comprising:

a shaft assembled on said machine body;

a threaded tube rotatably fitted around the outer side of said shaft, said threaded tube fitting and positioning thereon a tape roll of different widths; and two side covers respectively bored with a threaded hole in the center, said threaded holes respectively and threadably combined with the opposite ends of said threaded tube, said two side covers able to be rotatably adjusted in position to closely clamp the opposite outer sides of a tape roll fitted around said threaded tube, wherein said machine body is provided with two vertical combining plates spaced apart at a preset distance and respectively bored with an insert hole aligned to each other, and said shaft has one end formed with a rim with a comparatively large diameter and the other end formed with male threads, the end with said male threads of said shaft screwed with a locking nut to fix said shaft with said two combining plates after said shaft is inserted through both said two insert holes of said machine body and the interior of said threaded tube.

* * * * *